US006196136B1

(12) United States Patent
Yoshizaki et al.

(10) Patent No.: US 6,196,136 B1
(45) Date of Patent: Mar. 6, 2001

(54) CAR AND SIDE STRUCTURE FOR CAR AND METHOD OF MANUFACTURING THE SAME

(75) Inventors: Kiyoshi Yoshizaki, Iwakuni; Yasunari Igawa, Kudamatsu, both of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/202,396

(22) PCT Filed: Jun. 19, 1996

(86) PCT No.: PCT/JP96/01682

§ 371 Date: Dec. 9, 1998

§ 102(e) Date: Dec. 9, 1998

(87) PCT Pub. No.: WO97/48587

PCT Pub. Date: Dec. 24, 1997

(51) Int. Cl.[7] ..... B61D 17/00

(52) U.S. Cl. ..... 105/396; 105/397; 105/401; 105/404; 105/409; 52/53; 52/732

(58) Field of Search ..... 105/396, 397, 105/400, 401, 404, 409; 52/53, 732, 630, 795, 807, 813

(56) References Cited

U.S. PATENT DOCUMENTS

| | | | | |
|---|---|---|---|---|
| 2,314,979 | * | 3/1943 | Gunn | 105/401 |
| 2,870,723 | * | 1/1959 | Bock et al. | 105/401 |
| 5,267,515 | * | 12/1993 | Tsuruda et al. | 105/397 |
| 5,285,730 | * | 2/1994 | Fujinawa et al. | 105/401 |

FOREIGN PATENT DOCUMENTS

561396 A1 * 9/1993 (GB) ..... B61D/17/08

* cited by examiner

*Primary Examiner*—S. Joseph Morano
*Assistant Examiner*—Frantz F. Jules
(74) *Attorney, Agent, or Firm*—Antonelli, Terry, Stout & Kraus, LLP

(57) ABSTRACT

In order to provide a car-body structure which has few different kinds of structural members, a small number of structural members, a small occurrence of strain and which is high in dimensional accuracy, and, consequently, in assembling accuracy, each of the car-body blocks is formed of a one-piece structure consisting of an outside plate and a reinforcing plate, each of which is made of a metallic material. The reinforcing plate is composed of panels divided into a plurality of sections; and, each of the panels has a plurality of beads in the form of a long and narrow projection formed by plastic working of a metal plate and extending in the longitudinal direction of the block. A bar-ring in the form of a long hole with a rib extending in the direction of the block is formed between the beads through plastic working. Further, at least one post-shaped protrusion extending in the direction intersecting at a right angle with the bead is provided in each of panels of the reinforcing plate. The bead, the barring and the post-shaped protrusion are projected in one side of the surface of the panel; at least one end of the bead and the post-shaped protrusion are connected so as to form one structure; and the panel and the outside plate are joined in a unit.

9 Claims, 10 Drawing Sheets

CAR AND SIDE STRUCTURE FOR CAR AND METHOD OF MANUFACTURING THE SAME

TECHNICAL FIELD

The present invention relates to a car-body structure in which frame members are formed by press forming from a plate material, and a method of manufacturing the car-body, and a car using the car-body structure; and, more particularly, the invention relates to a car-body structure suitable for use as a side structure and an end structure of a rail-car, and a method of manufacturing the car-body structure.

BACKGROUND OF THE INVENTION

A conventional body structure for a rail-car, for example, a side structure, is manufactured by weld-joining a rocker rail, a side post, a belt rail, a window head, a window post, a door end post and so on.

Since the car-body structure is composed of many frame members, a frame formed in a one-piece structure is proposed in order to simplify the car-body structure.

In a car-body structure disclosed, for example, in Japanese Patent Application Laid-Open No.5-262228, a frame member is formed of corrugated plates divided into a plurality of sections and having a plurality of ribs, and the frame member is spot-welded to an outside plate. The frame member has holes on a surface in contact with the outside plate. Further, reinforcing members are welded and joined to the corrugated plates in a direction transversely intersecting with the corrugated plates.

In a car-body structure disclosed in Japanese Patent Application Laid-Open No.5-262227, ribs in the car-body structure according to the patent application are arranged so as to be staggered.

Further, in a car-body structure disclosed in Japanese Patent Application Laid-Open No.5-69823, a side structure is formed by joining a plurality of inner panels having projections and depressions formed by press working to a flat-plate outer panel to be used as an outside plate.

However, the above-mentioned car-body structures in, there is problem in that strain occurs and dimensional accuracy is degraded due to use of many kinds of members, a large number of parts and weld-joining of individual frame members.

Since the car-body structure disclosed in Japanese Patent Application Laid-Open No.5-262227 has a great number of long ribs in the longitudinal direction of the car-body, the stiffness of the car-body structure in the vertical direction is low. Therefore, additional posts are provided. Notches are provided in order to prevent the occurrence of wrinkles or cracks around a hole, which makes the manufacture complex.

In addition to this, since the reinforcing plate in each of the above cited references is fabricated by press working, strain is apt to occur and the surface flatness is degraded. When such a reinforcing plate is spot-welded to an outside plate, strain or unevenness occurs in the outside plate. Therefore, the dimensional accuracy is degraded, and, consequently, the assembling accuracy of the car-body is degraded.

The objective workpiece in each of, Japanese Patent Application Laid-Open No.5-262227, Japanese Patent Application Laid-Open No.5-262228 and Japanese Patent Application Laid-Open No.5-69823, has a side structure without a bending portion in a wainscot panel portion of the car-body. Therefore, the technology disclosed in each of the above-mentioned publication cannot be applied to a car-body having a bending portion in a wainscot panel portion of the car-body.

SUMMARY OF THE INVENTION

An object of the present invention is to provide a car-body which is composed of a small number of structural members and has a high stiffness, and a method of manufacturing the car-body.

Another object of the present invention is to provide a car-body in which strain in the structural members is small, and the dimensional accuracy, and consequently, assembling accuracy of the car-body is high, and a method of manufacturing the car-body.

A further object of the present invention is to provide a method of manufacturing a car-body which can be applied to a car-body structure having a bending portion in a wainscot panel portion of the car-body.

A characteristic of the present invention is in the provision of a car in which at least one of a side block, a roof block and an end block is formed of a one-piece structure consisting of an outside plate and a reinforcing plate;

the reinforcing plate is composed of panels, the panel having a bead of a long and narrow projection formed by plastic working of a metal plate and extending in the longitudinal direction of the block, a hole extending along the bead and a bar-ring formed through plastic working around the hole, and a post-shaped protrusion extending in the direction intersecting at right angle with the longitudinal direction of the bead and the bar-ring;

the bead, the bar-ring and the post-shaped protrusion are projected in one side of the surface of the panel;

at least one end of the bead and the post-shaped protrusion is connected so as to form one and the panel and the outside plate are joined in a unit. Another characteristic of the present invention is in the provision of a car in which at least one of a side block, a roof block and an end block is formed of a one-piece structure consisting of an outside plate and a reinforcing plate which are made of a metallic material;

the reinforcing plate is composed of panels, the panel having a bead of a long and narrow projection formed by plastic working of a metal plate and extending in the longitudinal direction of the block, and a post-shaped protrusion extending in the direction intersecting at right angle with the longitudinal direction of the bead;

at least one of the panels has a plurality of the beads;

each of the beads and the post-shaped protrusion are projected in one side of the surface of the panel;

the bead is formed through roll working under a compressing force as large as a load at the yield point or several times of the yield strength of a material the panel; and the panel and the outside plate are joined in a unit.

A further characteristic of the present invention is in the provision of a car in which the side block has a bending portion in a wainscot panel portion, and a depression extending in a direction intersecting at a right angle with the longitudinal direction of the post-shaped protrusion is formed on the top surface of the post-shaped protrusion corresponding to the bending portion.

In the reinforcing plate in accordance with the present invention, the number of parts can be reduced since portions for maintaining the strength of the reinforcing plate, that is, beads, bar-rings and post-shaped protrusions, are formed in a one-piece structure. Further, since at least one end of the bead and the post-shaped protrusion in the reinforcing plate are connected so as to form one structure through plastic working, the strength of the reinforcing plate against a vertical force and a horizontal force acting on the connecting portion becomes strong and a high rigidity can be attained. Therefore, it is possible to provide a car having a small number of structural members and a high rigidity, and a method of manufacturing the car.

Furthermore, the reinforcing plate has a plurality of beads and bar-rings in parallel and post-shaped protrusions in a direction intersecting at right angle with the beads, and a compressing force as large as the load at the yield point or several times the yield strength of the material of the panel is applied to the reinforcing plate in the thickness direction of the material in order to form the beads. Therefore, it is possible to provide a car having a high rigidity in the reinforcing plate, small stress in the structural member, a high dimensional accuracy and, accordingly, a high assembling accuracy.

By providing a plurality of ribs having a depressing rib on the upper rib portion of the one-piece panel, it is possible to absorb the difference between inner and outer peripheral lengths caused by bending. Therefore, the structure can be applied to various type of cars, even to a car having a bending portion in the wainscot panel portion.

BEST MODE FOR CARRYING OUT THE INVENTION

Figure 1:
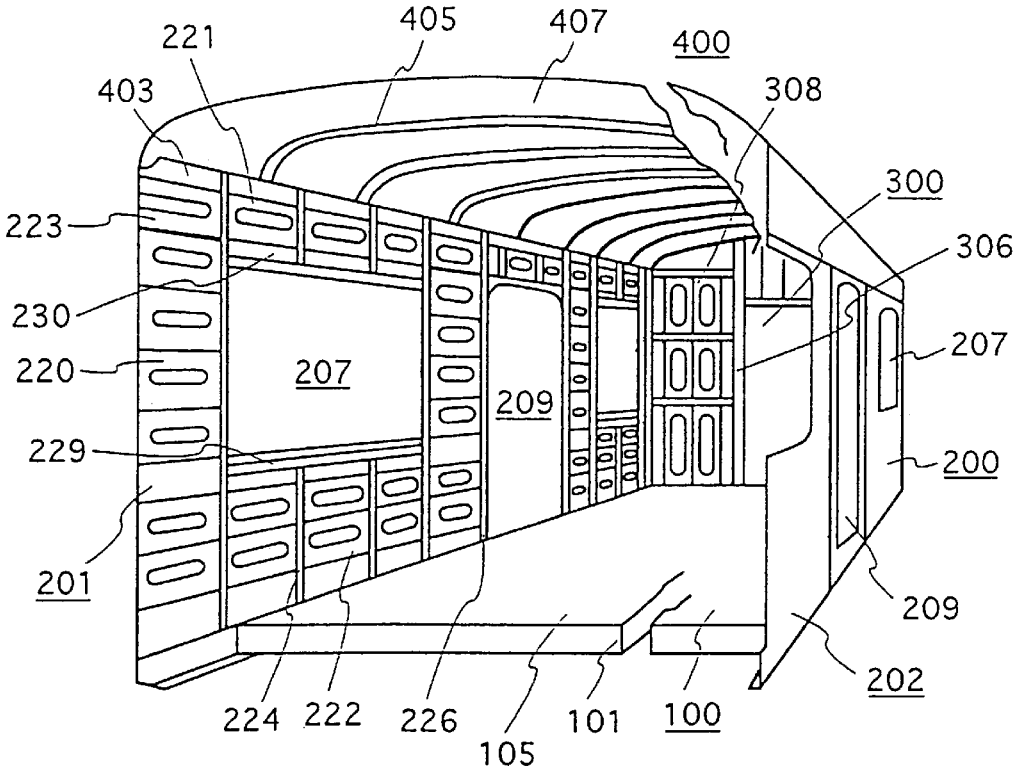
FIG. 1 is a perspective view of a car-body structure, of a rail-car without a bending portion in the wainscot panel portion, manufactured by a method in accordance with the present invention.
Figure 2:
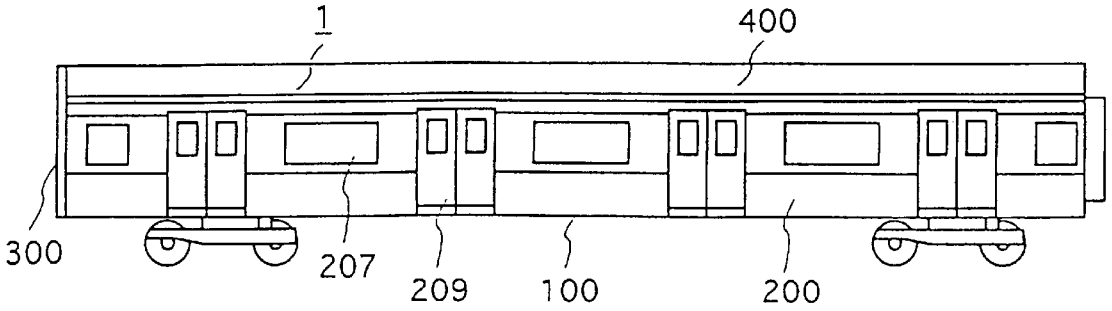
FIG. 2 is a side view showing a rail-car having the car-body structure of FIG. 1.
Figure 3:
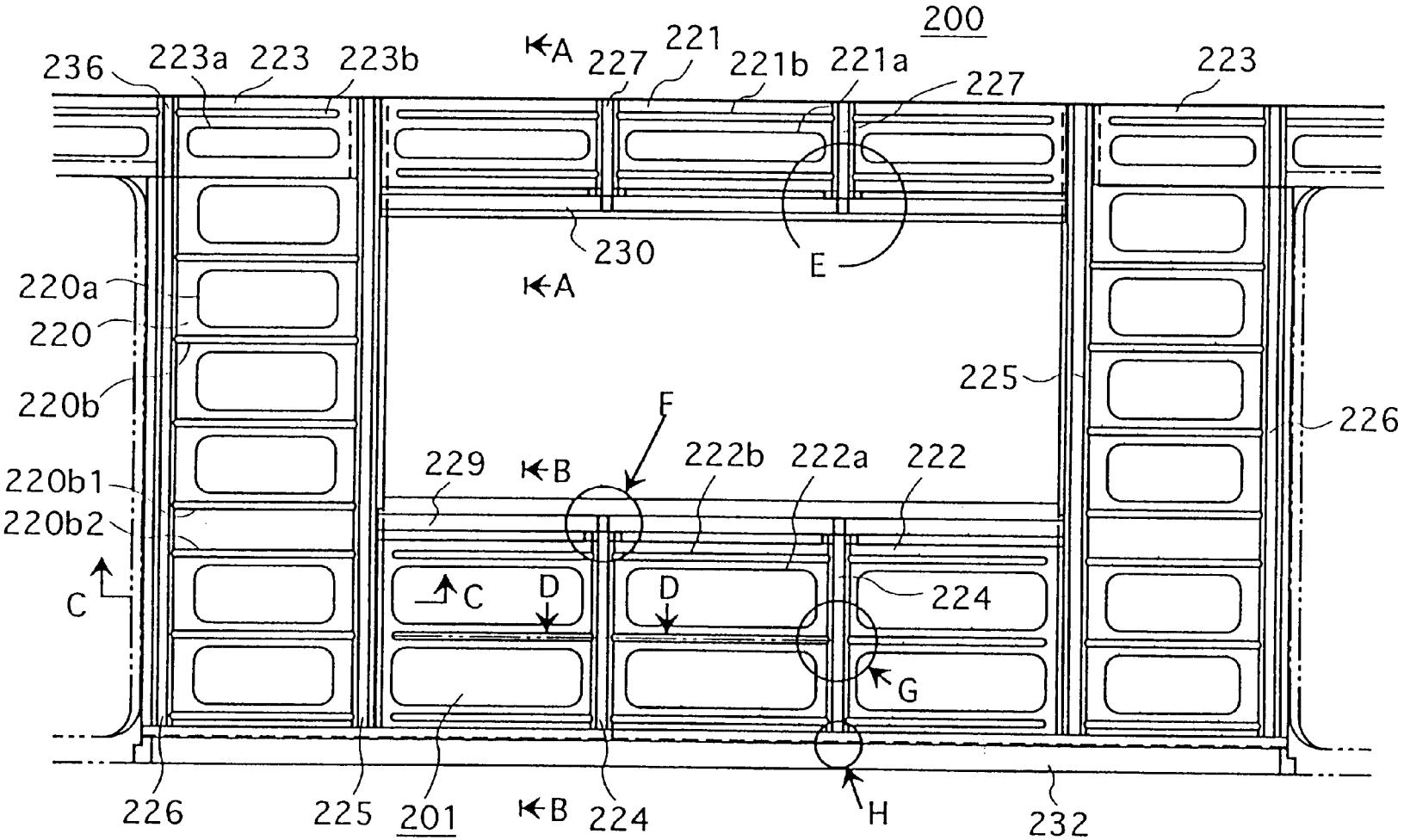
FIG. 3 is an enraged front view showing the main portion of a side block which represents one of the structural elements of the car-body structure.

An embodiment of the present invention will be described below with reference to FIG. 1 to FIG. 4. FIG. 1 is a perspective view of a car-body structure of a rail-car manufactured by a method in accordance with the present invention. FIG. 2 is a side view showing a rail-car having the car-body structure of FIG. 1. FIG. 3 is an enlarge front view showing the main portion of a side structure representing one of the structural elements of a car-body structure.

Referring to FIG. 1 and FIG. 2, a car-body structure 1 is constructed by blocks consisting of a floor block 100, side blocks 200, end blocks 300 and a roof block 400. In this embodiment, the car has no bending portion in the wainscot panel portion, and the side block 200 is flat-plate shaped.

The floor block 100 comprises a plurality of cross beams 101 made of stainless steel and extending in the lateral direction, a plurality of center beams made of stainless steel and intersecting at a right angle with the cross beams, a floor plate 105, such as a metal plate or a honeycomb panel placed on these beams and a mat made of a resin material spread over the floor.

The side block 200 is constructed with a side structure composed of a reinforcing plate 201 made of stainless steel, an outside plate 202 made of stainless steel and fixed onto the outer surface of the reinforcing plate to form a unit, and an inner plate, not shown, fixed on the inner side of the side structure.

In order to make it easy to understand the structure of the side block 200, FIG. 1 shows the reinforcing plate 201 as seen from the inside of the car-body 1 on left hand side and the outside plate 202 as seen from the outside of the car-body on the in right hand side.

In the side block 200, a plurality of window portions 207 and an entrance 209 are provided. The reinforcing plate 201 comprises a wainscot panel portion 222 under the window portion 207, a frieze board portion 221 above the window portion 207, a door pocket plate 220 between the window portion 207 and the entrance 209 and a door header panel portion 223 above the door pocket plates 220 and the entrance 209.

As shown in FIG. 3, the wainscot panel portion 222 comprises post-shaped protrusions 224 and a plate for a window sill 229 which are formed by deforming part of the reinforcing plate 201 into a projecting-shape or trapezoidal shape (hereinafter, referred to a "trapezoid-shape").

There is a rocker rail 232 in the lower end of the reinforcing plate 201 and the door pocket panel 220. The rocker rail is fixed to the outside plate 202 by spot-welding.

The outside plate 202 is divided into plurality of plates in advance, and end portions of the plates are overlapped and spot-welded to produce a unified structure.

The reinforcing plate 201 is formed by separately forming the door pocket plate 220, the frieze board portion 21, the wainscot panel portion 222, the door header panel portion 223 in advance and joining the panel portions to form a single unit. For example, the door pocket portion 220, the wainscot panel portion 222, the frieze board 221 and the door header panel portion 223 are arranged on predetermined positions at the inner side of the outside plate 202, and they are fixed to the outside plate 202 to form a unit by spot-welding. The lower end of the inner side of the outside plate 202 is spot-welded to the rocker rail 232 in the longitudinal direction.

A window header 230 and a window sill 229 are spot-welded to the inner side of the outside plate 202 in the portions above and below the window portion 207 along the window. End portions and the vicinity of the post-shaped protrusions 224, 227 of the wainscot panel portion 222 and the frieze board 221 are overlapped with and spot-welded to the top portions and the bottom portions of the window header 230 and the window sill 229.

The wainscot panel portion 222 comprises two post-shaped protrusions 224 (3 positions×3 stages), nine beads 222*b* along the longitudinal direction of the car-body, and six bar-rings 222*a* provided between the beads 222*b* (3 positions×2 stages).

The post-shaped protrusion 224, each of the beads 222*b*, and a portion (joining flange) 224*c* of the wainscot panel portion 222 over lapping with the door pocket plate 220 are projected toward the inner side of the car-body and are formed by plastic working of one sheet of plate.

The end block 300 is composed of end posts 306 and an end outside plate (placed outside of the reference character 308) and so on. The roof block 400 is composed of side plates 403, car-lines 405, an outside plate 407 and so on.

The reinforcing plate 201 of the side block 200 is formed by dividing and separately working a plurality of panel portions, such as the door pocket portion 220, the frieze board portion 221, wainscot panel portion 222, the door header panel portion 223 and so on, and then spot-welding the divided panels to the outside plate 202 in a unit to form a side structure.

The door pocket portion 220 comprises trapezoid (triangular) beads 220*b*, bar-rings 220*a*, a door end post 225 of a trapezoidal post-shaped protrusion and an entrance post 226 which are formed in a one-piece structure by press working. The hole formed by the bar-ring 220*a* in the door pocket portion 220 is to reduce the weight.

A conventional reinforcing plate has a large number of parts, since a plurality of reinforcing parts, which correspond to the beads, the bar-ring and the post-shaped protrusion in accordance with the present invention, for each of the blocks, such as a door pocket portion, a frieze board portion, a wainscot panel portion and a door header panel portion, are independently fabricated and then spot-welded to an outside plate. On the other hand, according to the present invention, the number of parts is small, since the portions for maintaining the strength of the reinforcing plate 201, that is, the beads, the bar-ring and the post-shaped protrusion, are formed in a one-piece structure by plastic working.

Further, a pair of beads 220*b*1, 220*b*2 provided in the door pocket portion 220 are formed in an upper portion and a lower portion of a narrow place with the extension line of the window sill 229 of the wainscot panel portion 222 located therebetween. There is provided no bar-ring between the pair of beads 220*b*1, 220*b*2. Thereby, the strength of the door pocket portion 220 is increased, and so the door pocket portion 220 can withstand a large horizontal force from the window sill 229.

The frieze board portion 221 comprises trapezoid beads 221*b*, bar-rings 221*a* and trapezoidal post-shaped protrusions, that is, window posts 227.

The wainscot panel portion 222 comprises trapezoidal beads 222*b*, six bar-rings 222*a* and two trapezoidal post-shaped protrusions 224. The bar-ring 222*a* is formed by protruding the periphery of a hole provided in the wainscot panel portion 222.

The door header panel portion 223 comprises beads 223*b*, bar-rings 223*a* and post-shaped protrusions, that is, door header posts 236. For a portion which requires not so a high a strength, a reduction in the weight may be performed by forming simple holes, instead of the bar-ring 220*a*.

The reinforcing plate 201 of the side block 200 is formed in a one-piece structure by using, for example, stainless steel as the working raw material, plastic-working the beads (220*b*, 221*b*, 222*b*), the bar-rings (220*a*, 221*a*, 222*a*), the trapezoidal ribs (224, 225, 226, 227, 236) and so on with a press, depending on the shape of each panel, and then spot-welding them.

Figure 4:
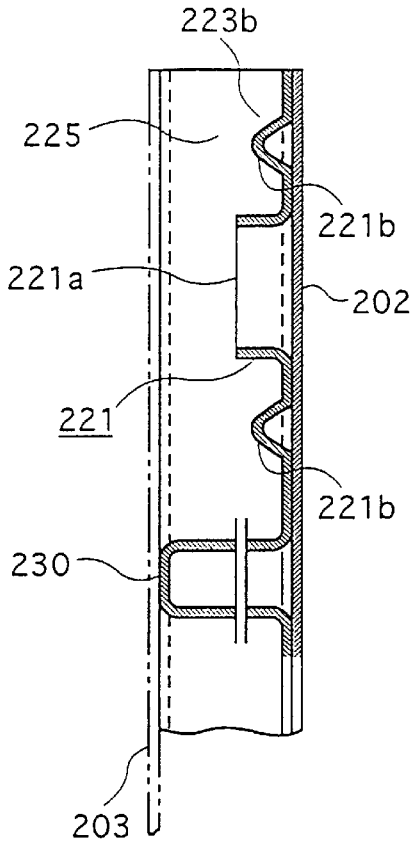
FIG. 4 is a cross-sectional view taken on the plane of the line A—A of FIG. 3.
Figure 5:
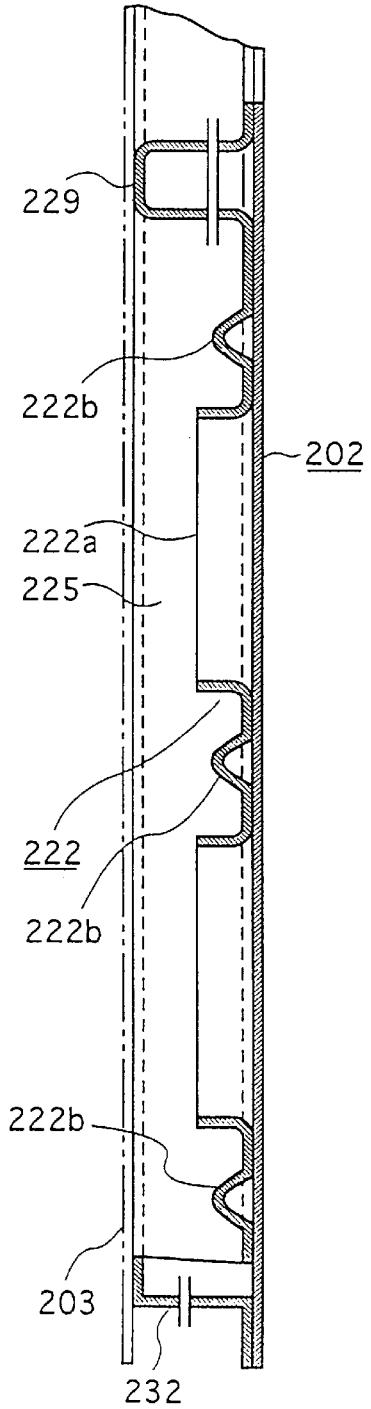
FIG. 5 is a cross-sectional view taken on the plane of the line B—B of FIG. 3.

FIG. 4 is a cross-sectional view of the frieze board portion 221 taken on the plane of the line A—A of FIG. 3. FIG. 5 is a cross-sectional view of the wainscot panel portion 222 taken on the plane of the line B—B of FIG. 3.

It can be understood from FIG. 4 and FIG. 5 that a characteristic of the present invention resides in the that, in a reinforcing plate 201, a plurality of beads and bar-rings are provided in parallel, and trapezoidal ribs or posts are provided in a direction intersecting at a right angle with the beads and the bar-rings, and, further, the ribs and the beads are connected. By doing so, the rigidity of the side block 200 can be increased. Particularly, by connecting the beads and the ribs, the strength is increased against a vertical force and a horizontal force acting on the connecting portion, and, accordingly, a high rigidity can be attained. Furthermore, by applying a compressing force as large as load at the yield point or several times of the yield strength of the steel material of the reinforcing plate in the thickness direction of the steel plate, strain caused by bead working can be suppressed to a small level and, accordingly, a reinforcing plate having small strain can be obtained. Herein, the reference character 203 indicates an inner plate.

A method of working the bead 222*b* is that initially beads are pre-formed by pressing the raw material with a force to cause a stress as the strong as tensile strength of the material. The bead is rolled by applying a high compressing force corresponding to the strength at the yield point or several times as large as the yield strength of the material all over the surface of the beads. The detailed method of working a bead is disclosed in Japanese Patent Application Laid-Open No. 63-32848.

Figure 6:
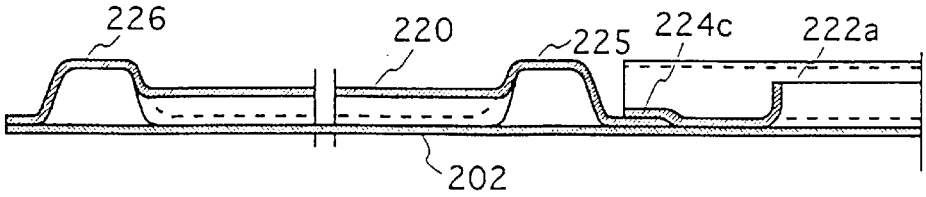
FIG. 6 is a cross-sectional view taken on the plane of the line C—C of FIG. 3.

FIG. 6 is a cross-sectional view taken on the plane of the line C—C of FIG. 3. The figure shows details of the trapezoidal door end post 225, the entrance post 226 and the connecting portion of the wainscot panel portion 222 and the bead 222*a*. Attaching flanges 224*c*, provided at both ends, in the longitudinal direction of the car-body, of the wainscot panel portion 222 and the adjacent door pocket plates 220 are overlapped and spot-welded.

Figure 7:
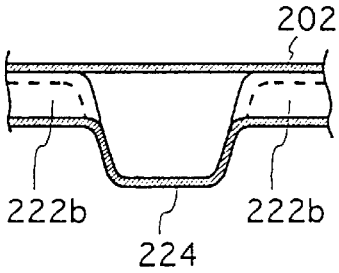
FIG. 7 is a cross-sectional view taken on the plane of the line D—D of FIG. 3.

FIG. 7 is a cross-sectional view taken on the plane of the line D—D of FIG. 3. The figure shows details of the connecting portion of the post-shaped protrusion 224 and the bead 222*b*. The bead 222*b* and the post-shaped protrusion 224 are protrusively formed together by a method to be described later .

Figure 8:
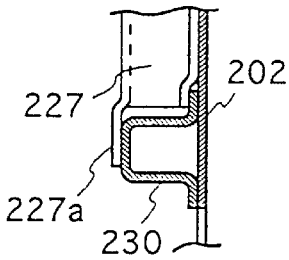
FIG. 8 is an enlarged cross-sectional view of the portion E of FIG. 3.

FIG. 8 is an enlarged cross-sectional view of the portion E of FIG. 3. The figure shows details of the connecting portion of the window header 230 and the window portion post 227. The window header 230 and the window portion post 227 are fixed together through a nail portion 227*a* extending from the top end of the trapezoidal window portion post 227.

Figure 10:
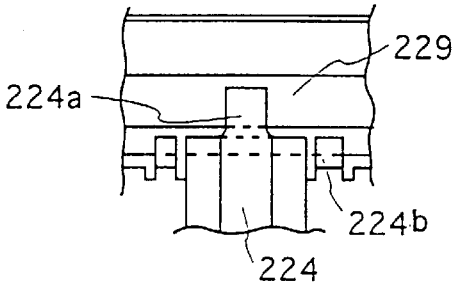
FIG. 10 is an enlarged front view of the portion F of FIG. 3.
Figure 9:
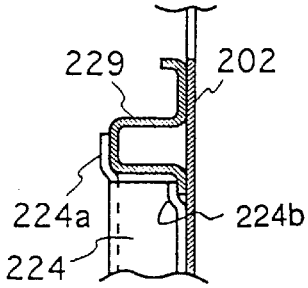
FIG. 9 is an enlarged cross-sectional view of the portion F of FIG. 3.

FIG. 9 and FIG. 10 are enlarged cross-sectional views of the portion F of FIG. 3. The figures show details of the connecting portion of the post-shaped protrusion 224 and the window sill 229. The post-shaped protrusion 224 and the window sill 229 are fixed together through a nail projection portion 224*a*, 224*b* extending from near the top end of the trapezoidal post-shaped protrusion 224.

Figure 11:
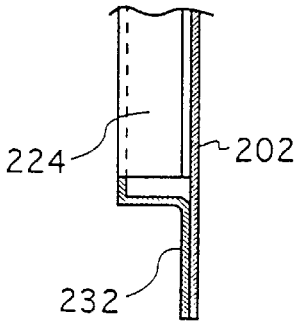
FIG. 11 is an enlarged cross-sectional view of the portion H of FIG. 3.

FIG. 11 is an enlarged cross-sectional view of the portion H of FIG. 3. The figure shows the detail of the post-shaped protrusion 224 and the rocker rail fixed to the lower end of the outside plate 202.

Figure 12:
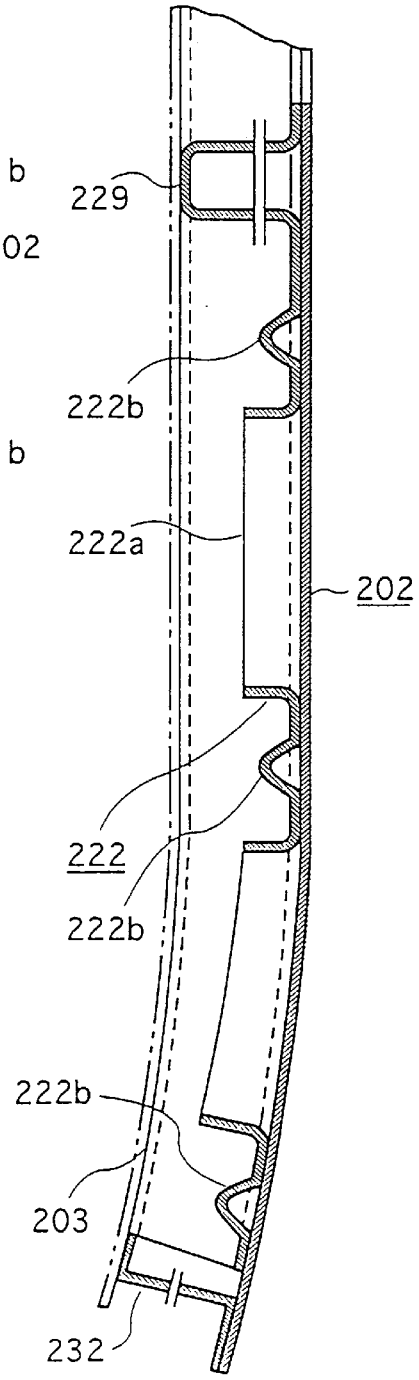
FIG. 12 is a cross-sectional view showing a portion of a car-body structure of a rail-car with a bending portion in the wainscot panel portion, which corresponds to the cross-sectional view taken on the plane of the line B—B of FIG. 3.

FIG. 12 is a cross-sectional view showing a portion of a car-body structure of a rail-car with a bending portion in the wainscot panel portion which corresponds to FIG. 5. The wainscot panel portion 222 is formed in the same manner as that of FIG. 5 and then is worked so as to be bent.

Figure 13:
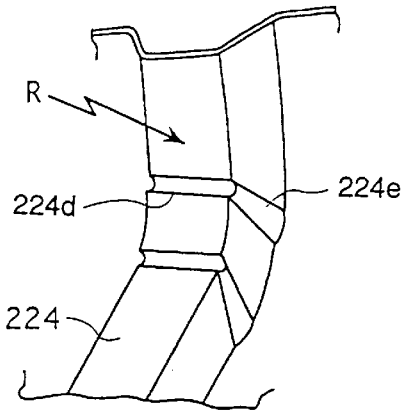
FIG. 13 is a perspective view showing a portion of a car-body structure of a rail-car with a bending portion in the wainscot panel portion, which corresponds to the portion G of FIG. 3, that is, the bending portion in the wainscot panel portion of the car body.

FIG. 13 is a perspective view showing a portion of a car-body structure of a rail-car with a bending portion in the wainscot panel portion which corresponds to the portion G of FIG. 3, that is, the bending portion in the wainscot panel portion of the car body. For a panel having a bend R in the wainscot panel portion, the difference between the inner and outer peripheral lengths in the bending direction caused by the bend R is absorbed by providing a plurality of ribs composed of a depressed rib 224*d* placed in the top surface of the trapezoidal post-shaped protrusion 224 and protruding ribs 224*e*, formed in both of the side surfaces in the rib member so as to extend in the direction normal to the bending direction, as shown in FIG. 13.

The magnitude of the bending of the bending portion R can be matched by varying the depth, pitch and number of the ribs 224*d*. For example, in a case where the bend R is large compared to the case of a small R, the depth and the height of the ribs are set smaller, and the pitch is set wider and the number is set smaller. The protruding rib 224*e* is formed in the side surface of the trapezoidal by plastic deforming at the same time that the depressing rib 22*d* is formed.

Figure 14:
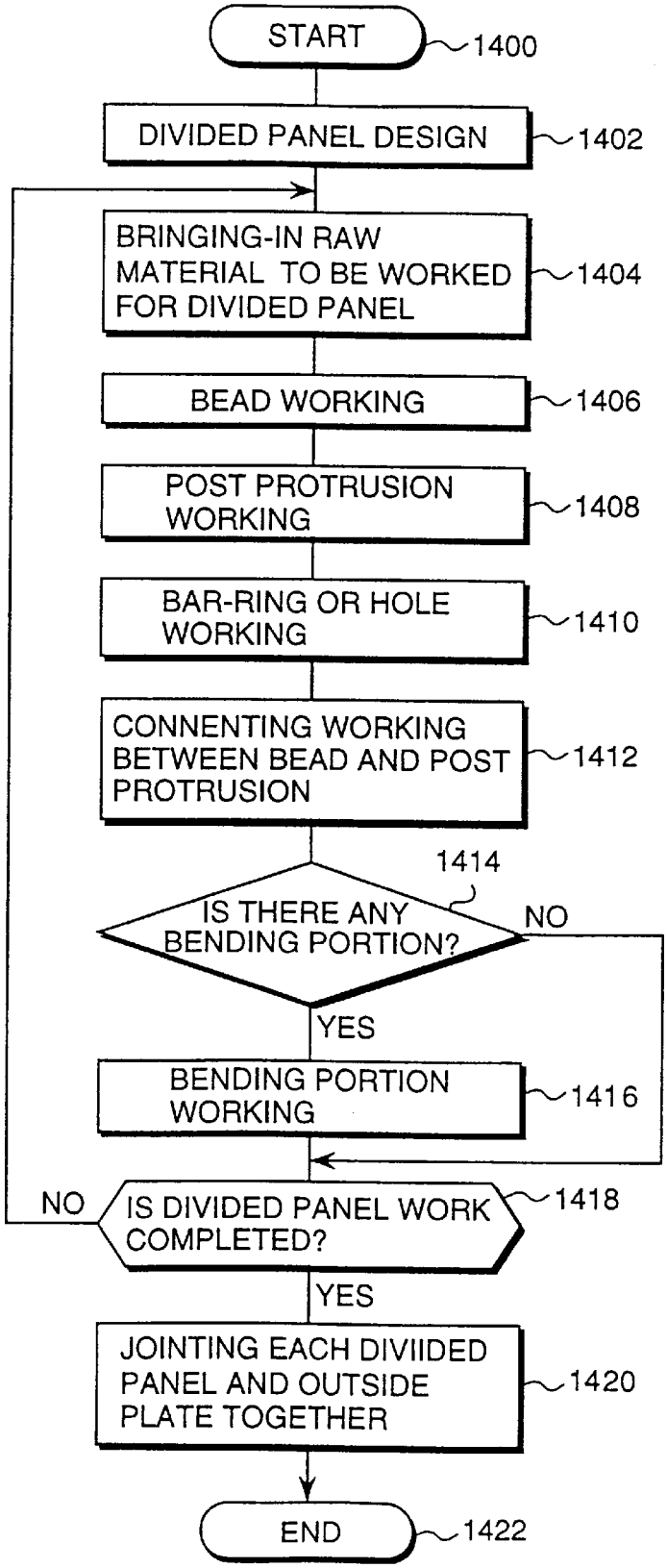
FIG. 14 is a flow diagram showing a process of manufacturing a side block of a car-body in accordance with the present invention.

A method of manufacturing the side block 200 in accordance with the present invention will be described below, referring to FIG. 14 and FIG. 15. Initially, an example of a wainscot panel portion of a car-body without bend will be described. As described above, the reinforcing plate 201 is composed of a plurality of panels 280, such as the door pocket plate 220, the frieze board portion 221, the wainscot panel portion 222, the door header panel portion 223 and so on, and the beads, the bar-rings and the ribs are provided corresponding to the shape of each of the panels. Therefore, the presence or absence of the bead, bar-ring and the rib in each of the panels and their shapes are different depending on the panel position in the reinforcing plate. Accordingly, it is necessary to design each of the panels as an assembly of optimum divided panels in advance (S1402). Herein, description will be made of a method of manufacturing a panel in the portion of the wainscot panel portion 222 as an example.

Firstly, a working raw material for manufacturing the panel 280 of the wainscot panel portion is brought in (S1404). As a material for the reinforcing plate 201 of the side block, for example, a rectangular stainless steel plate (SUS 301) having a plate thickness of nearly 0.8 mm is used. Projecting nails 224*a* are formed in one end of the steel plate, as shown in FIG. 15 at (*a*).

Next, a number of long narrow protrusions, that is, beads 222*b* having a height of, for example, nearly 8 mm extending in the horizontal (longitudinal) direction of the side block are formed in the steel plate (S1406). During the bead working, a bead is worked by pressing the working raw material of the steel plate using a bead working metal pattern for a rectangular bead of, for example, 25 mm width, 8 mm height and 200 mm length. Then, the steel plate is moved in the longitudinal direction by 180 mm which is slightly shorter than the length of the metal pattern, and the bead is worked in the same manner as indicated above. By doing so, the dimension in the longitudinal direction of the bead shape can be freely determined. According to this method, the flexibility of the metal pattern is high because one metal pattern can cope with different bead lengths.

In the bead working, after forming the long narrow protrusions, that is, the beads in the working raw material of the steel plate for the panel 280 in advance, the beads are pressed with a large force 4 to 5 times as large as the load at the yield point of the steel plate. That is, by applying a compressing force as large as the load at the yield point or several times the yield strength of the working material in the thickness direction, the bead working strain can be reduced and the strain in the panel 280 can be decreased to a low level. The working of the beads 222*b* is preferably performed prior to bar-ring working and post-shaped protrusion working in order to increase the working accuracy of the panel 280, that is, the reinforcing plate 201.

Further, the beads contribute to an increase in the rigidity of the whole reinforcing plate 201. Furthermore, in order to increase the rigidity, it is better to increase the height of the bead, for example, 10 to 15 times as high as the thickness of the plate and to increase the number of beads.

Figure 15:
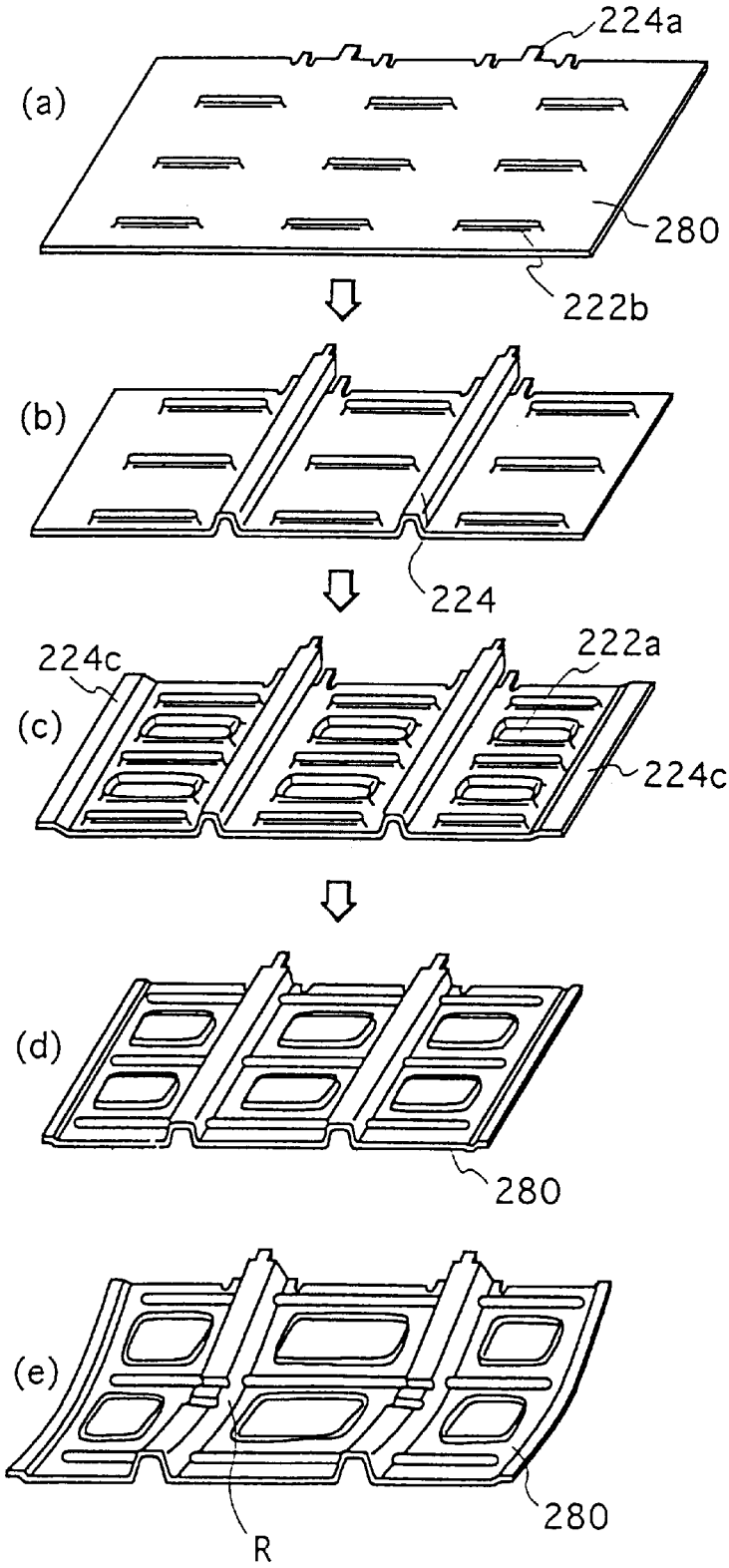
FIG. 15 is a view explaining the process of manufacturing the side block corresponding to the process of FIG. 14.

Next, a plurality of trapezoidal ribs, that is, wainscot panel portion post-shaped protrusions 224 having a height of nearly 40 mm extending in a direction intersecting at a right angle with the bead are formed by bending the panel between the beads 222*b*, 222*b* using an oil hydraulic press, as shown in FIG. 15 at (*b*) (S1408).

Further, holes parallel to each of the beads are formed between the beads of the steel plate using an oil hydraulic press, and long holes with rib having a height of, for example, nearly 10 mm, that is, bar-rings 222*a* are formed, as shown in FIG. 15 at (*c*) (S1410). According to this method, no wrinkle is produced in the surface to be in contact with the outside plate, which is different from in the conventional method, and manufacturing of the wainscot panel portion can be easily performed.

Further, attaching flanges 224*c* are formed in both end sides of the steel plate. The flange 224*c* has a step so as to overlap on the end portion of a post 225 of the door pocket plate portion 220. Further, steps are formed in the projecting nails 224*a*, 224*b* so as to overlap the top portion and the end portion of the window sill 229.

Although there are six bar-rings in the panel in the example shown in FIG. 15, at the time of working six holes are bored using a single metal pattern at a time. At the same time, bar-rings of these six holes are also formed using a single metal pattern at a time. At that time, the steps are formed by pressing in the protruding nails 224*a*, 224*b* and the attaching flanges 224*c* at the same time.

By the process as described above, the panel 280 having trapezoidal ribs extending in the direction crossing the beads and the bar-rings formed in a unit, that is, reinforcing plate 201, is manufactured through press working of a steel plate.

In the following process, by pressing the portion between the end of the bead 222*b* and the post 224 of the panel with a force larger than the load at the yield point of the steel plate using an oil hydraulic press, the end of the bead 222*b* is connected to the post-shaped protrusion 224 of the wainscot panel portion to form one piece, as shown in FIG. 15 at (*d*). By connecting the end of the bead 222*b* and the post-shaped protrusion 224 of the wainscot panel portion in one piece as described above, the rigidity of the reinforcing plate 201 can be further increased (S1412). In other words, by connecting the bead and the post-shaped protrusion, the strength to a vertical force and a horizontal force acting on the connecting portion can be increased and a higher rigidity can be attained. The bead working in this step may be performed using a press having a common pressing force.

By the same method as used for the wainscot panel portion 222, as described above, the reinforcing plate 201 for the door pocket plate portion 220, the frieze board portion 221 or the door header panel portion 223 can be manufactured as a panel 280 having the beads, the bar-rings and the ribs worked in a steel plate. The presence or absence of the bead, bar-ring and the rib in each of the panels 280 and their shapes are different depending on the panel position in the reinforcing plate.

For example, in the panel composing the reinforcing plate of the door pocket plate portion 220, the trapezoidal door end post 225 and the trapezoidal entrance post 226 vertically extending are formed in both end portions, respectively, and a plurality of the beads 220*b* and a plurality of the bar-rings 220*a* are alternately formed in the middle portion. Both ends of each bead 220*b* are continued to the door end post and the entrance post 226.

In the upper end of the door pocket plate portion 220, only the door end post 225 is projected upward compared to the other portions. The door pocket plates 220 are arranged at both sides of the entrance. Therefore, the door header panel 223 is placed in the space from the door end post 225 in one of the door pocket plates 220 to the door end post 225 in the other of the door pocket plates 220.

Further, in the panel composing the reinforcing plate of the frieze board portion 221, two trapezoidal window posts 227 extending vertically are formed in the middle portion, and one bar-ring 220*a* is formed between two beads 220*b* extending in the horizontal direction. The end of each of the beads 220*b* is continued to the window post 227. The attaching flanges in both ends of the panel are overlapped with the bottom portion in the end portion of the door end post 225.

Further, the bead 223*a* and the bar-ring 223*b* extending in the horizontal direction and the door header panel post 236 extending vertically are formed in the panel composing the reinforcing plate of the door header panel portion 223. One end of the bead 223*b* is continued to the door header panel post 236. The attaching flange in one end of the panel is overlapped with the bottom portion in the end portion of the door end post 225.

Beads are formed in the end portions in the vertical direction of each of the panels. The reason for this is that strain is apt to occur in the end portion at the time of plastic working, and the beads suppress the strain.

Each of the panels 280 of the reinforcing plate 201 formed in such a manner is placed on an outside plate 202, and the ends of the adjacent panels of the door pocket plate portion 220, the frieze board portion 221, the wainscot panel portion 222, the door header panel portion 223, the window sill 229 and the window header 230 are overlapped. Then, these overlapped portions and the overlapped portions with the outside plate 202 are spot-welded. By doing so, the structure of the side block 200 is completed (S1420).

In a case where the side block 200 has a bend in the wainscot panel portion of a car-body, working of the bending portion R is further performed to the panel 280, as shown in FIG. 15 (*e*) (S1416). This work is independently performed for each of the panels of the reinforcing plates 201 prior to joining them with the outside plate.

Figure 17:
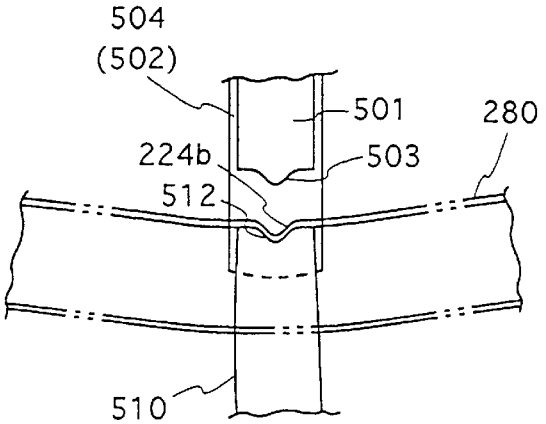
FIG. 17 is a cross-sectional view taken on the plane of the line A—A of FIG. 16.
Figure 16:
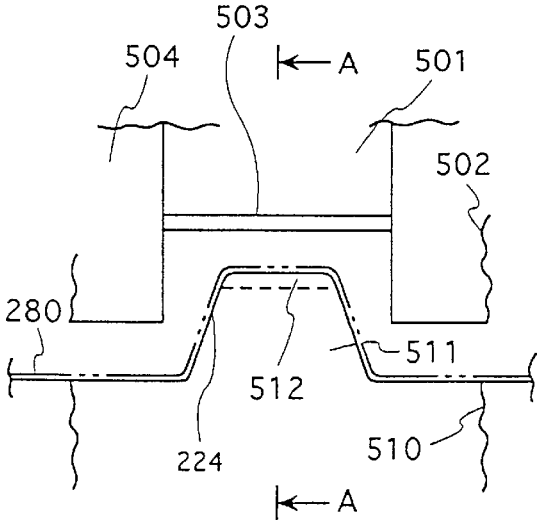
FIG. 16 is an enlarged front view showing the main portion of a metal pattern used for working a bending portion in a wainscot panel portion of a car-body.

Working of the bending portion will be described below, referring to FIG. 12 and FIG. 16 to FIG. 21. FIG. 16 is an enlarged front view showing the main portion of a metal pattern used for working a bending portion. FIG. 17 is a cross-sectional view taken on the plane of the line A—A of FIG. 16. A bending portion of the reinforcing plate 201 having a rib member, such as a post-shaped protrusion 224, is press-formed by one upper metal pattern composed of three upper patterns (501, 502, 504) and one lower metal pattern (510). The upper pattern 501 has a protruding portion 503 corresponding to the denting rib 224*d* provided in the top surface of a trapezoid of a side post, and a denting groove 512 is provided in the top surface of a protruding portion 511 of the lower metal pattern 510.

It can be understood from FIG. 17 that the lateral directions of the upper metal pattern and the lower metal pattern are arcuate surfaces having a radius of curvature which agrees with a radius of curvature of the bending portion of the wainscot panel portion of the car-body. The surfaces of the top end portions of the right and the left upper patterns 502, 504 are formed so as to press the bottom surfaces of the trapezoids of the side posts, that is, the surfaces the bar-ring holes. Further, the distance between the top end portions of the right and the left upper patterns 502, 504 is so large that part of the panel material can be projected outward from the side surfaces to form the protruding portions 224*e* when the denting rib 224*d* is formed.

Figure 18:
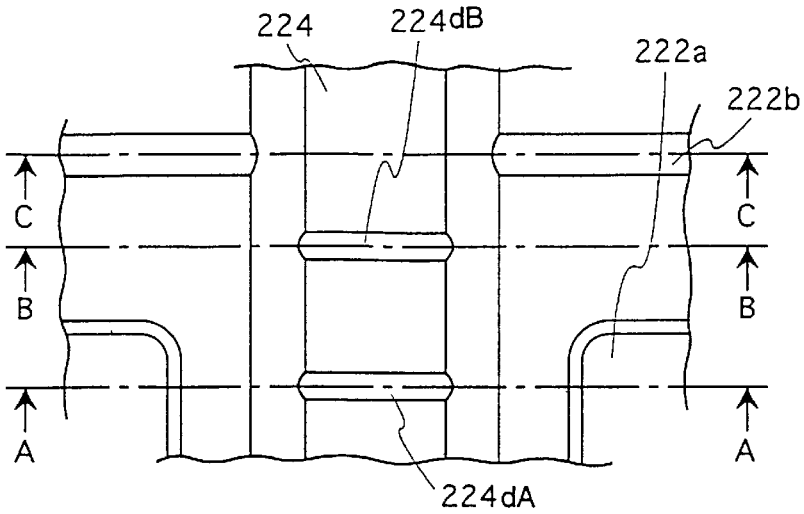
FIG. 18 is a plan view showing a bending portion in a wainscot panel portion of a car-body formed by a method in accordance with the present invention.
Figure 19:
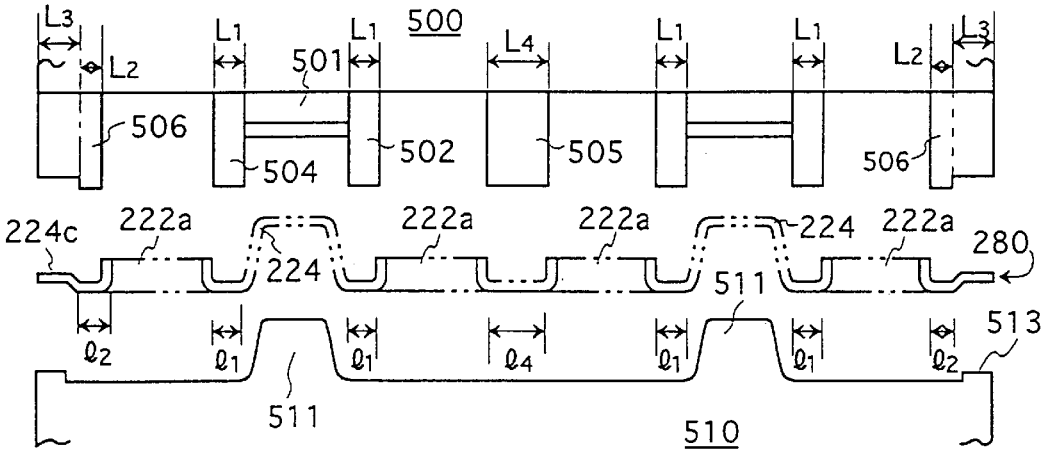
FIG. 19 is a vertical cross-sectional view showing a metal pattern for working a portion along the line A—A of FIG. 18
Figure 20:
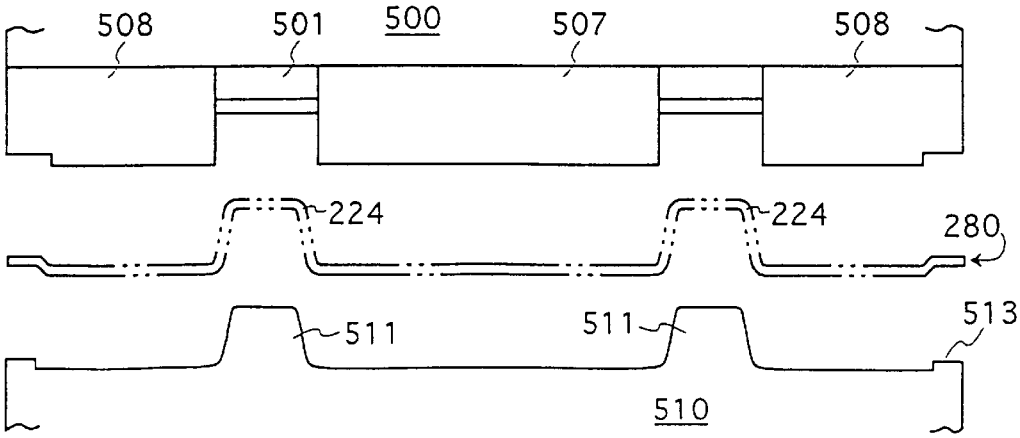
FIG. 20 is a vertical cross-sectional view showing a metal pattern for working a portion along the line B—B of FIG. 18.
Figure 21:
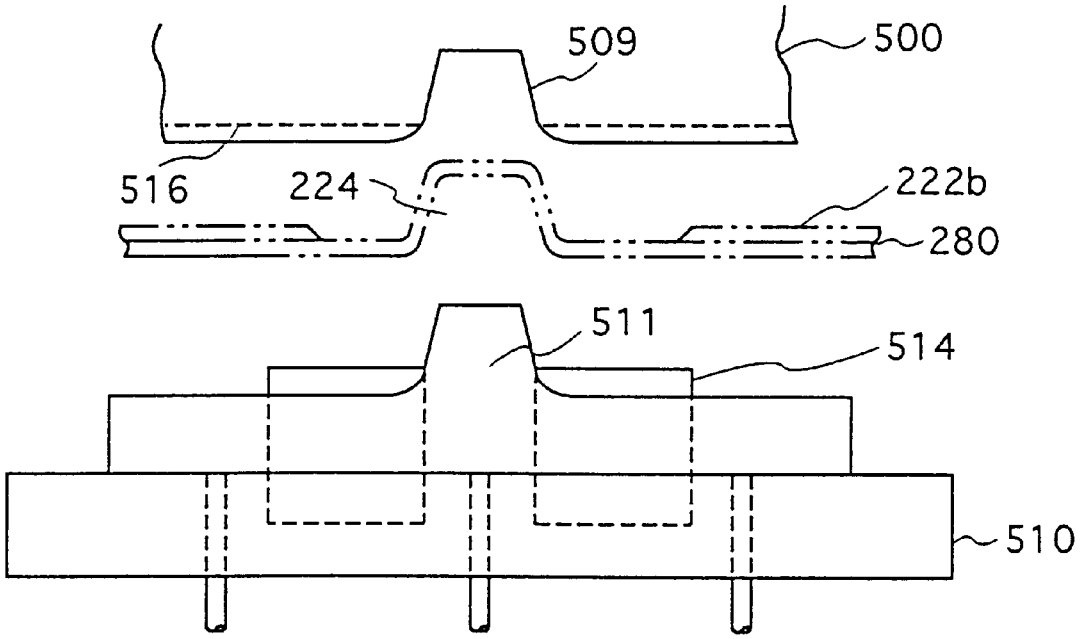
FIG. 21 is a vertical cross-sectional view showing a metal pattern for working a portion along the line C—C of FIG. 18.

FIG. 18 shows bending portions of a panel 280 to be bending-worked, and FIG. 19 to FIG. 21 show examples of the metal patterns corresponding to various worked positions of the bending portions. Each of FIG. 19 to FIG. 21 shows a state in which the upper metal pattern and the lower metal pattern are separated after completion of the bending work on the panel 280.

A rib 224*d*A of the post-shaped protrusion 224 and holes of bar-rings 222*a* exist on the line A—A of FIG. 18. A metal pattern having a shape shown in FIG. 19 is used for the portion along the line A—A in the panel 280, that is, the portion having the rib 224*d*A of the post-shaped protrusion 224 and the holes of the bar-rings 222*a*.

As for the upper metal pattern used, an upper pattern 505 for pressing between the bar-ring and the bar-ring of the panel and a metal pattern 506 for press attaching flanges 224*c* in both end portions of the panel are added to the upper patterns (501, 502, 504) of the upper metal pattern 500, shown in FIG. 16. As for the lower metal pattern, a lower pattern 513 for pressing the attaching flanges 224*c* in both end portions of the panel is added.

Letting the length from the bottom of the post-shaped protrusion 224 to the bar-ring 222*a* be $l_1$ and the width between the upper patterns 502, 504 be $L_1$, the relation between them is $L_1<l_1$ (FIG. 19).

Letting the length from the bar-ring 222*a* to the attaching flange 224*c* be $l_2$ and the width of the upper pattern 506 be $L_2$, the relation between them is $L_2<l_2$. The reference character $L_3$ denotes a portion necessary for pressing both end portions of the panel.

Further, letting the length between one bar-ring and an adjacent bar-ring be $l_4$ and the width of the upper pattern 505 be $L_4$, the relation between them is $L_4<l_4$. Essentially, no upper pattern exists on the bar-ring holes.

A rib 224*d*B of the post-shaped protrusion 224 exists on the line B—B of FIG. 18. The rib 224*d*B is formed so as to be positioned on the middle line between the bead 222*b* and the bar-ring 222*a*. A metal pattern having a shape shown in FIG. 20 is used for the portion along the line B—B in the panel 280, that is, the portion having the rib 224*d*B of the post-shaped protrusion 224 and the flat portions corresponding to the bottom surface of the post-shaped protrusion 224. As for the upper metal pattern, upper patterns 507, 508 for press-forming the flat portions are added to the upper patterns shown in FIG. 16. As for the lower metal pattern, a protruding portion 513 for pressing both end portions of the panel exists in the lower pattern 510.

For example, working of the rib 224*d*A of FIG. 18 is performed using the metal pattern of FIG. 19 to bend the panel along the line A—A, and then the rib 224*d*B is formed using the metal pattern of FIG. 20. The bending radius of the panel can be decreased by successively forming the ribs, bending the panel and increasing the number of ribs, as described above. No rib is formed on the extension line of the bead.

The post-shaped protrusion 224 and beads 222*b* exist on the line C—C of FIG. 18. One end of the bead is connected to the post-shaped protrusion 224. A metal pattern having a shape shown in FIG. 21 is used for working the portion along the line C—C in the panel 280, that is, the portion connecting the post-shaped protrusion 224 and the bead 222*b* (S1412 of FIG. 14). The upper metal pattern has a dent 509 for press-forming the post-shaped protrusion 224, denting portions 516 for forming a bead connecting to the bead 222*b* between the end portion of the bead 222*b* and the side surface of the post-shaped protrusion 224 and flat portions. This bead 222*b* is worked in the step S1406 of FIG. 14.

The lower metal pattern has a protruding portion 511 for press-forming the post-shaped protrusion 224 and connecting bead pieces 514 for press-forming the bead 222*b* so as to continue to the post-shaped protrusions 224 and a flat portion.

Another method of manufacturing a panel 280 composing the reinforcing plate 201 in the wainscot panel portion of the side block in accordance with the present invention will be described below, referring to FIG. 22.

In the panel 280, there are formed beads 222*b*, bar-rings 222*a* and attaching flanges 224*c* made of a material, such as steel, or stainless steel integrated in a one-piece structure by press-working. There are two types of beads 222*b*, that is, continuous bead 222*b*1 in the horizontal direction and discrete bead 222*b*2. The manufacturing steps up to forming this shape are the same as in the above-mentioned embodiment (S1402 to S1410 of FIG. 14). However, there is no step corresponding to S1408.

Then, the panel is inserted into a metal pattern covering the whole of the panel 280 and the panel is pressed from both the upper side so as and the lower side to be bent. The panel is bent at a portion where the beads 222*b* do not exist. The attaching flanges 224*c* are formed in at both ends of the panel using this metal pattern. The panel of this embodiment does not have the trapezoidal post 224 in the wainscot panel portion. Therefore, the panel 280 is suitable for a reinforcing plate 201 used in a portion requiring not so much strength. For example, it can be considered that the reinforcing plate 201 is used for a reinforcing plate composing the door pocket plate portion 220.

A further method of manufacturing a panel 280 composing the reinforcing plate 201 in the wainscot panel portion of the side block in accordance with the present invention will be described below, referring to FIG. 23. In the panel 280, in the same manner as shown in FIG. 22, beads 222*b* and bar-rings 222*a* made of a material such as steel or stainless steel integrated in a one-piece structure are formed by press-working. However, the reinforcing plate 201 is flat and without a bending portion. Further, wainscot panel portion posts 290 are separately manufactured by folding-working. In the side surfaces of the wainscot panel portion post 290, notches 292 are provided in the portions intersecting with the bead 222*b*. Flange portions 294 of the wainscot panel portion post 290 are spot-welded to the flat surface of the panel 280. After that, the panel is bending-worked for the bending portion by the step S1416 in the method of FIG. 14.

Figure 22:
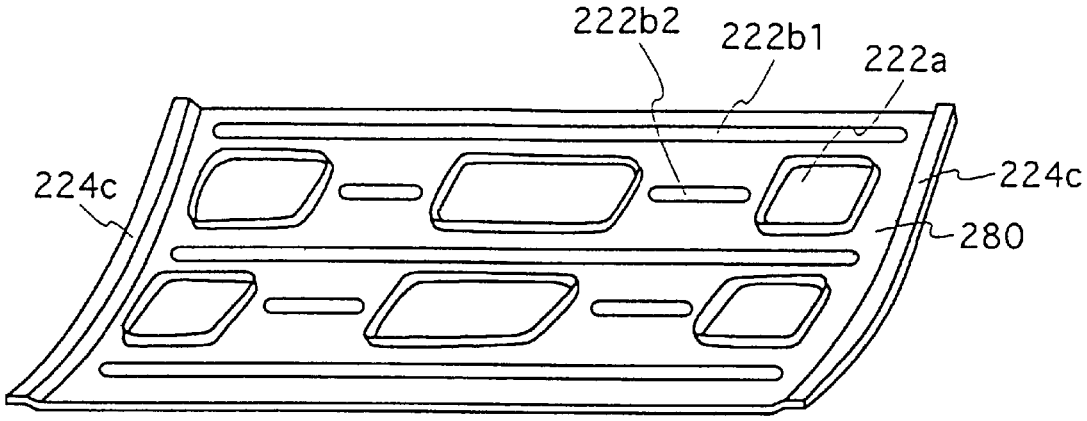
FIG. 22 is a perspective view for explaining another method of manufacturing a wainscot panel forming a side block in accordance with the present invention.
Figure 23:
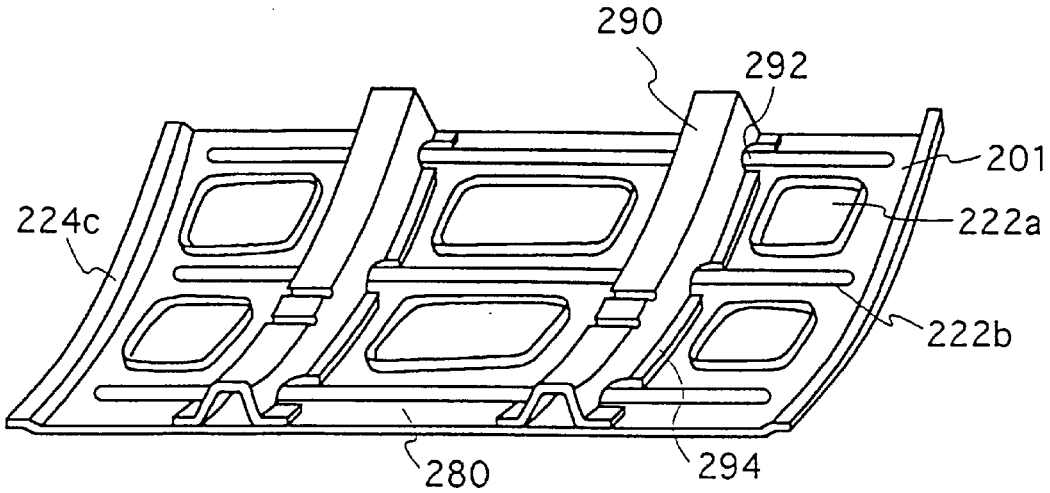
FIG. 23 is a perspective view for explaining a further method of manufacturing a wainscot panel forming a side block in accordance with the present invention.

Posts separately bending-worked may be spot-welded to the panel 280 with the bending portion obtained in the embodiment of FIG. 22.

Further, the structure of a side block may be manufactured by a method in which each of the panels 280 of the reinforcing plates 201 for the door pocket plate portion 220, the frieze board portion 221, the wainscot panel portion 222 and the door header panel portion 223 are manufactured by selectively combining the method described above, the panels 280 formed in such a way are placed on an outside plate 202, the ends of the panels adjacent to each other are overlapped, and these overlapped portions and the portions which overlap with the outside plate 228 are spot-welded.

The reinforcing plate in accordance with the present invention has been described by taking the side block 200 of the car-body structure 1 as an example. However, it is needless to say that by taking advantage of the characteristics of a decreased number of parts, high rigidity and low strain, the present invention can be applied to the reinforcing plates for the end block 300 and the roof block 400 in addition to the side block.

For example, the end post 306 and the end outside plate 308 of the end block 300 can be manufactured by providing a plurality of beads and bar-rings extending in the longitudinal direction in parallel in the reinforcing plate and by providing post-shaped protrusions in the direction intersection at a right angle with the longitudinal direction.

Further, the side plate 405 and the outside plate 407 of the roof block 400 can be manufactured by providing a plurality of beads and bar-rings extending in the longitudinal direction of the block in parallel in the reinforcing plate and by joining a panel having post-shaped protrusions in the direction intersecting at a right angle with the longitudinal direction to the outside plate.

As described above, in the reinforcing plate in accordance with the present invention, portions for maintaining the strength of the reinforcing plate, that is, beads, bar-rings and post-shaped protrusions, are formed in a one-piece structure through plastic working. By forming the portions for maintaining the strength in a one-piece structure, the number of parts and the number of welding points can be reduced and, accordingly, the man-power required for assembly can be substantially reduced. Further, since at least one end of the bead and the post-shaped protrusion in the reinforcing plate are connected so as to form one structure through plastic working, the strength of the reinforcing plate against a vertical force and a horizontal force acting on the connecting portion becomes strong and a high rigidity can be attained. Therefore, it is possible to provide a car-body structure having a high rigidity.

Further, the reinforcing plate has a plurality of beads and bar-rings in parallel and post-shaped protrusions in the direction intersecting at a right angle with the beads, and a compressing force as large as the load at the yield point or several times the yield strength of the material of the panel is applied to the reinforcing plate in the thickness direction of the material in order to form the beads. Therefore, it is possible to provide a car having a high rigidity in the reinforcing plate, small stress in the structural member, a high dimensional accuracy and, accordingly, a high assembling accuracy.

Furthermore, since the panel has low strain, the surface of the outside plate, that is, the outside surface of the car-body, becomes flat and, accordingly, the appearance is improved.

In addition to these features, in the side structure having a bending portion in the wainscot panel portion of the car-body, a plurality of ribs are provided in the rib portion of the panel in order to absorb the difference of length between inner and outer peripheries due to bending. By varying the depth, pitch and number of the ribs depending on the magnitude of the bending, it is possible to obtain a panel structure having a shape corresponding to any bend in the wainscot panel portion of a car-body, and, therefore, the application range can be substantially increased.

The reinforcing plate may be employed in a partial position of the side block. For example, in a car in which each of widows is arranged corresponding to each of seats, the width of the window is small and the interval between the windows is narrow. Various conventional reinforcing members can be arranged between the windows.

What is claimed is:

1. A car comprising a pair of end blocks forming walls extending in the width direction of the car and provided on a floor block, a roof block forming a roof of the car and a pair of side blocks forming side walls extending in the longitudinal direction of the car, wherein at least one of said side block, said roof block and said end block is formed of a one-piece structure consisting of an outside plate and a reinforcing plate;

said reinforcing plate being composed of panels, at least one of said panels having a bead of a long and narrow projection formed by plastic working of a metal plate and extending in the longitudinal direction of said block, a hole extending along said bead and a bar-ring formed through plastic working around said hole, and a post-shaped protrusion extending in a direction intersecting at a right angle with the longitudinal direction of said bead and said bar-ring;

said bead, said bar-ring and said post-shaped protrusion being projected from one side surface of said panel;

at least one end of said bead and said post-shaped protrusion being connected so as to form one structure through plastic working; and said panel and said outside plate being joined to form a unit, wherein said bead of said panel, said bar-ring and said post-shaped protrusion are formed in the same member through plastic working.

2. A car comprising a pair of end blocks forming walls extending in the width direction of the car and provided on a floor block, a roof block forming a roof of the car and a pair of side blocks forming side walls extending in the longitudinal direction of the car, wherein at least one of said side block, said roof block and said end block is formed of a one-piece structure consisting of an outside plate and a reinforcing plate which are made of a metallic material;

said reinforcing plate being composed of panels, at least one of said panels having a bead of a long and narrow projection formed by plastic working of a metal plate and extending in the longitudinal direction of said block, and a post-shaped protrusion extending in a direction intersecting at a right angle with the longitudinal direction of said bead;

at least one of said panels having more than one of said bead;

each said bead and said post-shaped protrusion being projected from one said surface of said panel;

said bead being formed through roll working under a compressing force as large as any one of a load at the yield point and several times the yield strength of the material of said panel; and said panel and said outside plate being jointed to form a unit, wherein said post-shaped protrusion is formed at both ends in the longitudinal direction of said beads.

3. A car comprising a pair of end blocks forming walls extending in the width direction of the car and provided on a floor block, a roof block forming a roof of the car and a pair of side blocks forming side walls extending in the longitudinal direction of the car, wherein at least one of said side block, said roof block and said end block is formed of a one-piece structure consisting of an outside plate and a reinforcing plate which are made of a metallic material;

said reinforcing plate being composed of panels, at least one of said panels having a bead of a long and narrow projection formed by plastic working of a metal plate and extending in the longitudinal direction of said block, and a post-shaped protrusion extending in a direction intersecting at a right angle with the longitudinal direction of said bead;

at least one of said panels having more than one of said bead;

each said bead and said post-shaped protrusion being projected from one said surface of said panel;

said bead being formed through roll working under a compressing force as large as any one of a load at the yield point and several times the yield strength of the material of said panel; and said panel and said outside plate being jointed to form a unit, wherein ends of said beads are connected to said post-shaped protrusion so as to form one structure through plastic working.

4. A car comprising a pair of end blocks forming walls extending in the width direction of the car and provided on a floor block, a roof block forming a roof of the car and a pair of side blocks forming side walls extending in the longitudinal direction of the car, wherein at least one of said side block, said roof block and said end block is formed of a one-piece structure consisting of an outside plate and a reinforcing plate;

said reinforcing plate being composed of panels, at least one of said panels having a bead of a long and narrow projection formed by plastic working of a metal plate and extending in the longitudinal direction of said block, a hole extending along said bead and a bar-ring formed through plastic working around said hole, and a post-shaped protrusion extending in a direction intersecting at a right angle with the longitudinal direction of said bead and said bar-ring;

said bead, said bar-ring and said post-shaped protrusion being projected from one side surface of said panel;

at least one end of said bead and said post-shaped protrusion being connected so as to form one structure through plastic working; and said panel and said outside plate being joined to form a unit, wherein height of said bead is 10 to 15 times as large as the plate thickness of said panel material.

5. A car comprising a pair of end blocks forming walls extending in the width direction of the car and provided on a floor block, a roof block forming a roof of the car and a pair of side blocks forming side walls extending in the longitudinal direction of the car, wherein at least one of said side block, said roof block and said end block is formed of a one-piece structure consisting of an outside plate and a reinforcing plate;

said reinforcing plate being composed of panels, at least one of said panels having a bead of a long and narrow projection formed by plastic working of a metal plate and extending in the longitudinal direction of said block, a hole extending along said bead and a bar-ring formed through plastic working around said hole, and a post-shaped protrusion extending in a direction intersecting at a right angle with the longitudinal direction of said bead and said bar-ring;

said bead, said bar-ring and said post-shaped protrusion being projected from one side surface of said panel;

at least one end of said bead and said post-shaped protrusion being connected so as to form one structure through plastic working; and said panel and said outside plate being joined to form a unit, wherein said side block has a bending portion in a wainscot panel portion, and a depression extending in a direction intersecting at a right angle with the longitudinal direction of said post-shaped protrusion is formed on the top surface of said post-shaped protrusion corresponding to said bending portion.

6. A car comprising a pair of end blocks forming walls extending in the width direction of the car and provided on a floor block, a roof block forming a roof of the car and a pair of side blocks forming side walls extending in the longitudinal direction of the car, wherein at least one of said side block, said roof block and said end block is formed of a one-piece structure consisting of an outside plate and a reinforcing plate;

said reinforcing plate being composed of panels, at least one of said panels having a bead of a long and narrow projection formed by plastic working of a metal plate and extending in the longitudinal direction of said block, a hole extending along said bead and a bar-ring formed through plastic working around said hole, and a post-shaped protrusion extending in a direction intersecting at a right angle with the longitudinal direction of said bead and said bar-ring;

said bead, said bar-ring and said post-shaped protrusion being projected from one side surface of said panel;

at least one end of said bead and said post-shaped protrusion being connected so as to form one structure through plastic working; and said panel and said outside plate being joined to form a unit, wherein a door pocket plate has a post-shaped protrusion on both sides of the door pocket plate in the longitudinal direction of the car, and a bead is arranged between said post-shaped protrusions.

7. A car comprising a pair of end blocks forming walls extending in the width direction of the car and provided on a floor block, a roof block forming a roof of the car and a pair of side blocks forming side walls extending in the longitudinal direction of the car, wherein at least one of said side block, said roof block and said end block is formed of a one-piece structure consisting of an outside plate and a reinforcing plate which are made of a metallic material;

said reinforcing plate being composed of panels, at least one of said panels having a bead of a long and narrow projection formed by plastic working of a metal plate and extending in the longitudinal direction of said block, and a post-shaped protrusion extending in a direction intersecting at a right angle with the longitudinal direction of said bead;

at least one of said panels having more than one of said bead;

each said bead and said post-shaped protrusion being projected from one said surface of said panel;

said bead being formed through roll working under a compressing force as large as any one of a load at the yield point and several times the yield strength of the material of said panel; and said panel and said outside plate being jointed to form a unit, wherein height of said bead is 10 to 15 times as large as the plate thickness of said panel material.

8. A car comprising a pair of end blocks forming walls extending in the width direction of the car and provided on a floor block, a roof block forming a roof of the car and a pair of side blocks forming side walls extending in the longitudinal direction of the car, wherein at least one of said side block, said roof block and said end block is formed of a one-piece structure consisting of an outside plate and a reinforcing plate which are made of a metallic material;

said reinforcing plate being composed of panels, at least one of said panels having a bead of a long and narrow projection formed by plastic working of a metal plate and extending in the longitudinal direction of said block, and a post-shaped protrusion extending in a direction intersecting at a right angle with the longitudinal direction of said bead;

at least one of said panels having more than one of said bead;

each said bead and said post-shaped protrusion being projected from one said surface of said panel;

said bead being formed through roll working under a compressing force as large as any one of a load at the yield point and several times the yield strength of the material of said panel; and said panel and said outside plate being jointed to form a unit, wherein said side block has a bending portion in a wainscot panel portion, and a depression extending in a direction intersecting at a right angle with the longitudinal direction of said post-shaped protrusion is formed on the top surface of said post-shaped protrusion corresponding to said bending portion.

9. A car comprising a pair of end blocks forming walls extending in the width direction of the car and provided on a floor block, a roof block forming a roof of the car and a pair of side blocks forming side walls extending in the longitudinal direction of the car, wherein at least one of said side block, said roof block and said end block is formed of a one-piece structure consisting of an outside plate and a reinforcing plate which are made of a metallic material;

said reinforcing plate being composed of panels, at least one of said panels having a bead of a long and narrow projection formed by plastic working of a metal plate and extending in the longitudinal direction of said block, and a post-shaped protrusion extending in a direction intersecting at a right angle with the longitudinal direction of said bead;

at least one of said panels having more than one of said bead;

each said bead and said post-shaped protrusion being projected from one said surface of said panel;

said bead being formed through roll working under a compressing force as large as any one of a load at the yield point and several times the yield strength of the material of said panel; and said panel and said outside plate being jointed to form a unit, wherein a door pocket plate has a post-shaped protrusion on both sides of the door pocket plate in the longitudinal direction of the car, and a bead is arranged between said post-shaped protrusions.

* * * * *